US005671808A

United States Patent [19]

Kleyn

[11] Patent Number: 5,671,808

[45] Date of Patent: Sep. 30, 1997

[54] POLYMERIC RADIATORS

[76] Inventor: Hendrik Kleyn, 5522 Kenowa, SW., Grandville, Mich. 49418

[21] Appl. No.: 507,802

[22] Filed: Jul. 26, 1995

[51] Int. Cl.[6] ..... F28D 1/03; F28F 3/14

[52] U.S. Cl. ..... 165/148; 165/164; 165/170; 165/171; 165/174

[58] Field of Search ..... 165/170, 171, 165/164, 174, 148

[56] References Cited

U.S. PATENT DOCUMENTS

| | | | |
|---|---|---|---|
| 1,356,676 | 10/1920 | Weller et al. | 165/148 |
| 2,021,995 | 11/1935 | Heath | 165/170 X |
| 2,585,736 | 2/1952 | Burr | 165/170 X |
| 2,856,164 | 10/1958 | Adams | 165/148 |
| 2,932,491 | 4/1960 | Miller | 165/148 |
| 2,957,679 | 10/1960 | Campbell | 165/148 |
| 3,331,436 | 7/1967 | Pauls | 165/170 |
| 4,228,851 | 10/1980 | Labarge et al. | 165/170 |
| 4,285,497 | 8/1981 | Ostbo | 165/170 X |
| 4,662,561 | 5/1987 | Dietzsch et al. | 165/170 X |
| 5,284,203 | 2/1994 | Dauvergne | 165/174 X |
| 5,368,467 | 11/1994 | Kleyn . | |

FOREIGN PATENT DOCUMENTS

| | | | |
|---|---|---|---|
| 1494592 | 9/1967 | France | 165/170 |

*Primary Examiner*—Leonard R. Leo
*Attorney, Agent, or Firm*—Warner Norcross & Judd

[57] ABSTRACT

A polymeric radiator having front and back radiator halves, that cooperate to define a primary coolant passage and a series of secondary coolant passages. The primary coolant passage includes integral internal baffles extending inwardly from the radiator halves. The internal baffles define passageways to allow coolant to flow through the radiator. Preferably, the passageways do not intersect the mating edges of the front and back radiator halves to enhance the structural integrity of the radiator.

5 Claims, 3 Drawing Sheets

POLYMERIC RADIATORS

BACKGROUND OF THE INVENTION

The present invention relates to radiators, and more particularly, to a radiator for an automobile.

Radiators are used to transfer heat energy from a medium flowing through the interior of the radiator to the air surrounding the radiator. In a typical automobile, coolant heated by the engine flows through the radiator to transfer heat from the engine to ambient air. A water pump or coolant pump driven by the engine continuously pumps coolant from the engine to the radiator for cooling and then back to the engine to provide a continuous cooling cycle.

A conventional radiator typically includes a core or grill extending between inlet and outlet manifolds. The core includes a dense assembly of thin parallel coolant passages that interconnect the inlet and outlet manifolds. The coolant passages increase the surface area of the radiator thereby increasing the rate of heat transfer from the radiator. The coolant enters the inlet manifold through an inlet port and flows to the outlet manifold through the core where the majority of heat transfer takes place. Upon reaching the outlet manifold, much of the heat energy has dissipated from the coolant. The coolant then flows back to the engine through an outlet port in the outlet manifold.

Conventional radiators are manufactured from metal components. For example, a typical radiator includes steel manifolds and copper coolant passages. Manufacture of a conventional radiator requires fabrication and assembly of both the manifolds and the core as well as installation of the core between the inlet and outlet manifolds. The manufacturing process is both laborious and time consuming. Conventional metal radiators are not only expensive to manufacture, but they are also subject to corrosion—particularly the coolant passages of the core. In addition, metal radiators are relatively heavy thereby increasing both shipping costs and the weight of the automobile.

SUMMARY OF THE INVENTION

The aforementioned problems are overcome by the present invention which provides a polymeric radiator having two radiator halves that are adjoined to define a primary coolant passage surrounding a series of secondary coolant passages.

In a first aspect of the invention, the primary passage is formed with integral internal baffles. The internal walls not only improve the structural integrity of the radiator, but they also slow the flow of coolant through the radiator to increase the residence time of coolant within the radiator to increase the temperature drop of the coolant.

In a second aspect of the invention, passageways are provided through the internal walls at a location other than the intersection of the two radiator halves. The structural integrity of the radiator is improved by the bonding of all mating edges of both the external walls and internal baffles. The position of the passageways out of alignment with the mating edges provides increased bonding area.

In a third aspect of the invention, at least some of the internal baffles are angled with respect to the flow of coolant through the primary passage. The angled baffles create turbulence which reduces the rate of flow of coolant through the radiator.

These and other objects, advantages, and features of the invention will be more readily understood and appreciated by reference to the detailed description of the preferred embodiment and the drawings.

DETAILED DESCRIPTION OF THE PREFERRED EMBODIMENT

I. Radiator

Figure 1:
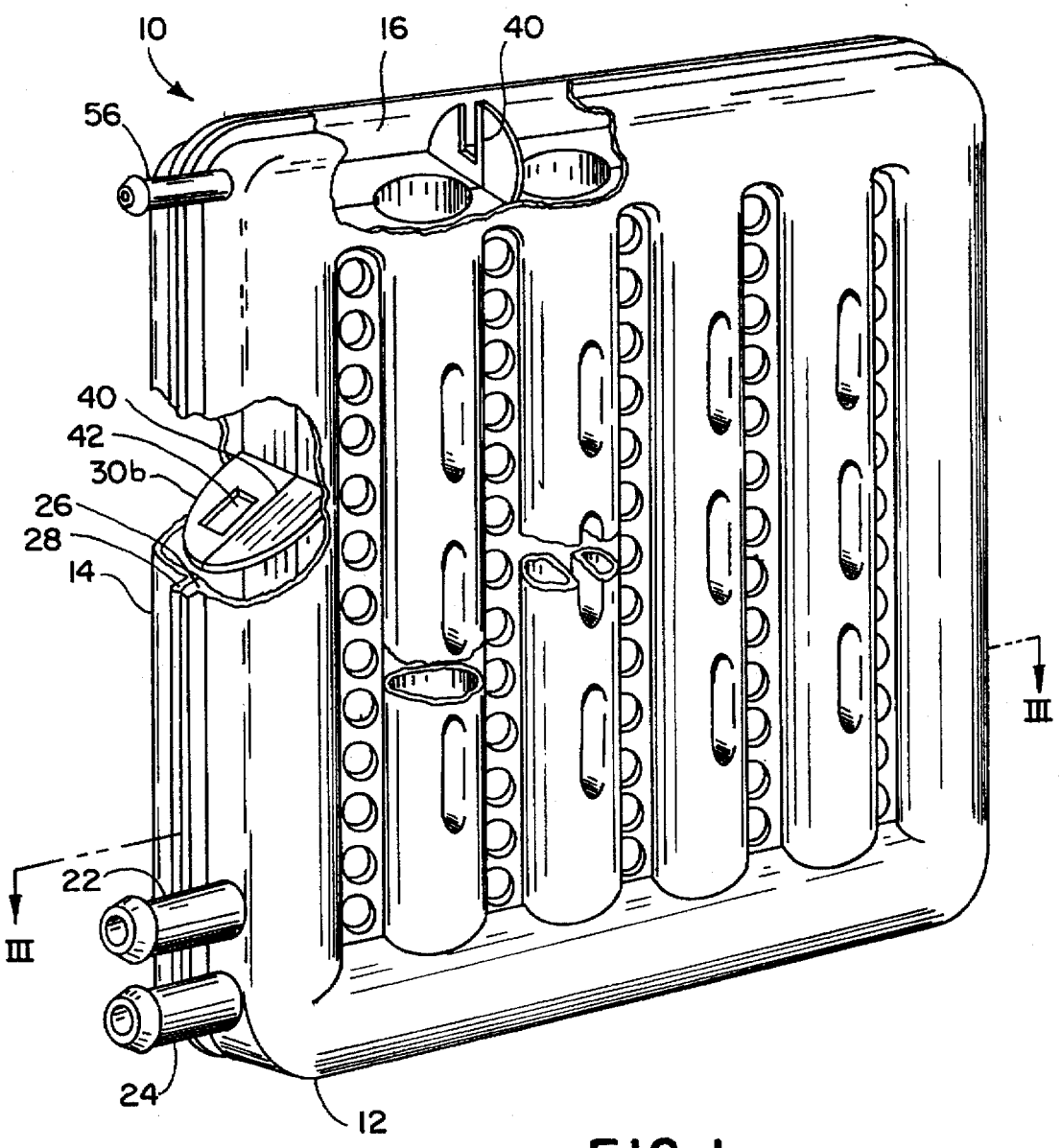
FIG. 1 is a perspective view of the radiator with portions cut away.

A polymeric radiator constructed in accordance with a preferred embodiment of the invention is illustrated in FIG. 1, and generally designated 10. For purposes of this disclosure, an embodiment of the invention adapted for use with an automobile will be described. However, the present invention is readily adapted for use in other applications.

Figure 2:
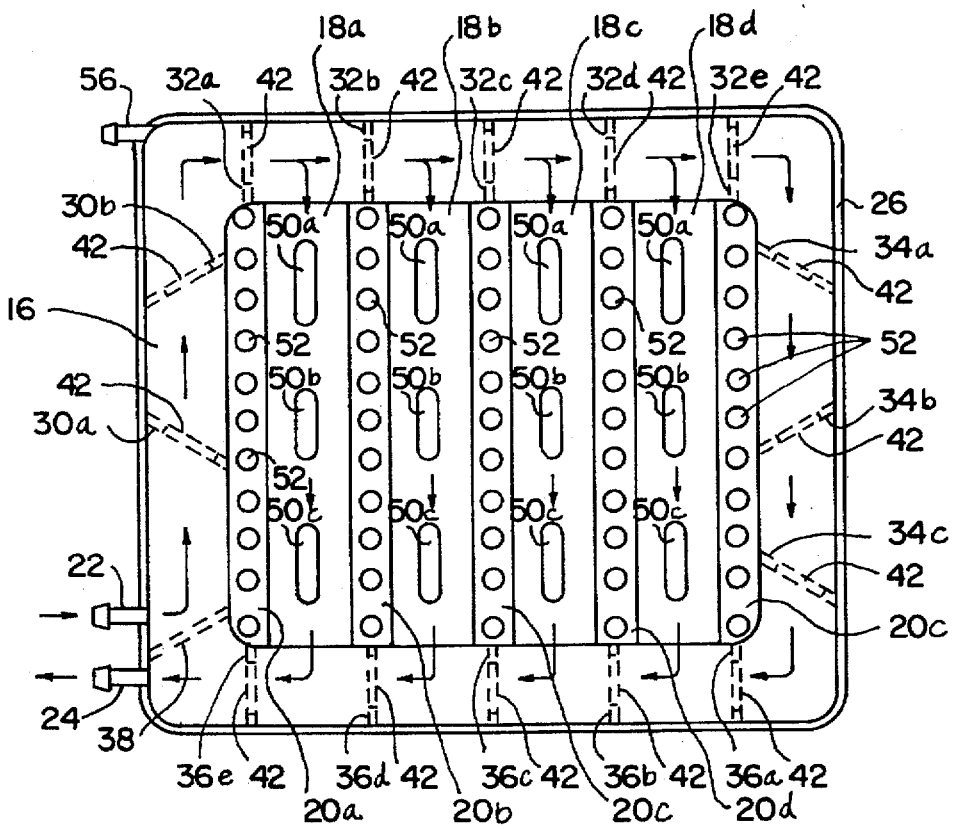
FIG. 2 is front elevational view of the radiator.

As perhaps best illustrated in FIG. 2, coolant enters the radiator 10 through an inlet pipe 22, flows through primary passage 16 and secondary passages 18*a–d*, and exits the radiator 10 through outlet pipe 24. As the coolant travels through the radiator, a portion of its heat energy is transferred to the radiator 10 and in turn to the ambient air surrounding the radiator.

The radiator 10 is an assembly of a front radiator half 12 and a back radiator half 14. The front and back radiator halves 12, 14 cooperate to define primary coolant passage 16, secondary coolant passages 18*a–d*, and heat deflectors 20*a–e*. The perimeters of both front radiator half 12 and back radiator half 14 are formed with flanges 26 and 28, respectively. The flanges 26, 28 are mated and affixed together by suitable means, preferably by heat welding, so as to form a leak-tight seal.

The primary passage 16 is formed by blocking a circuitous passage surrounding the secondary passages and heat deflectors of the radiator with an internal dividing wall 38. As illustrated in FIG. 2, dividing wall 38 is located between inlet pipe 22 and outlet pipe 24. The interior of primary passage 16 is divided into a series of cells by a plurality of internal baffle walls 30*a–b*, 32*a–e*, 34*a–c*, and 36*a–e* integrally formed with the front and back radiator halves 12, 14. Baffle walls 30*a–b* and 34*a–c* are formed at an angle with respect to the flow of coolant through primary passage 16. Each baffle wall is formed as a single thickness, or layer, of plastic material. The edges of the internal walls of the two radiator halves meet along a seam 40 lying in the same plane defined by the mating surfaces of the flanges 26, 28 (see FIG. 1).

The internal baffle walls 30*a–b*, 32*a–e*, 34*a–c*, and 36*a–e* are integrally formed with openings or passageways 42 which allow the coolant in the radiator 10 to pass from cell to cell. The size of passageways 42 can be varied to provide the desired coolant flow rate. To increase the structural integrity of radiator 10, passageways 42 are preferably undercut. This means that the passageways 42 do not intersect the mating edges of the internal baffles walls. A method and apparatus for integrally forming radiator halves 12, 14 with internal walls and undercut openings is described in greater detail below.

Figure 3:
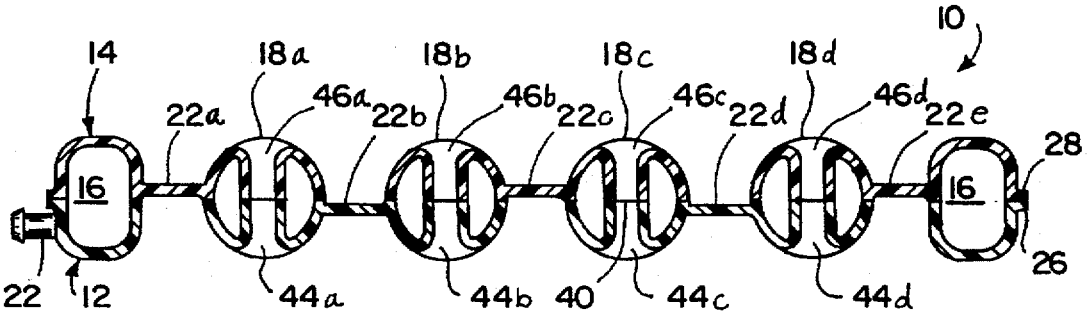
FIG. 3 is a plan, sectional view of the radiator taken along line III—III of FIG. 1.

The secondary passages are integrally formed with the front and back radiator halves 12, 14. Opposite ends of each secondary passage 18*a–d* are in fluid communication with primary passage 16. As perhaps best illustrated in FIG. 3, the front radiator half 12 forms the front half 44*a–d* of each secondary passage 18*a–d* while the back radiator half 14 forms the back half 46*a–d* of each secondary passage. The edges of the front and back halves 44*a–d*, 46*a–d* of the secondary passages 18*a–d* meet along seam 40 lying in the same plane defined by the mating surfaces of the flanges 26, 28. While the preferred embodiment includes four secondary passages, the number of secondary passages may vary from application to application. A series of air flow channels 50*a–c* are formed through each of the secondary passages 18*a–d* to increase the surface area of the radiator 10. The number, dimensions, and arrangement of the air flow channels may vary from application to application.

Figure 4:
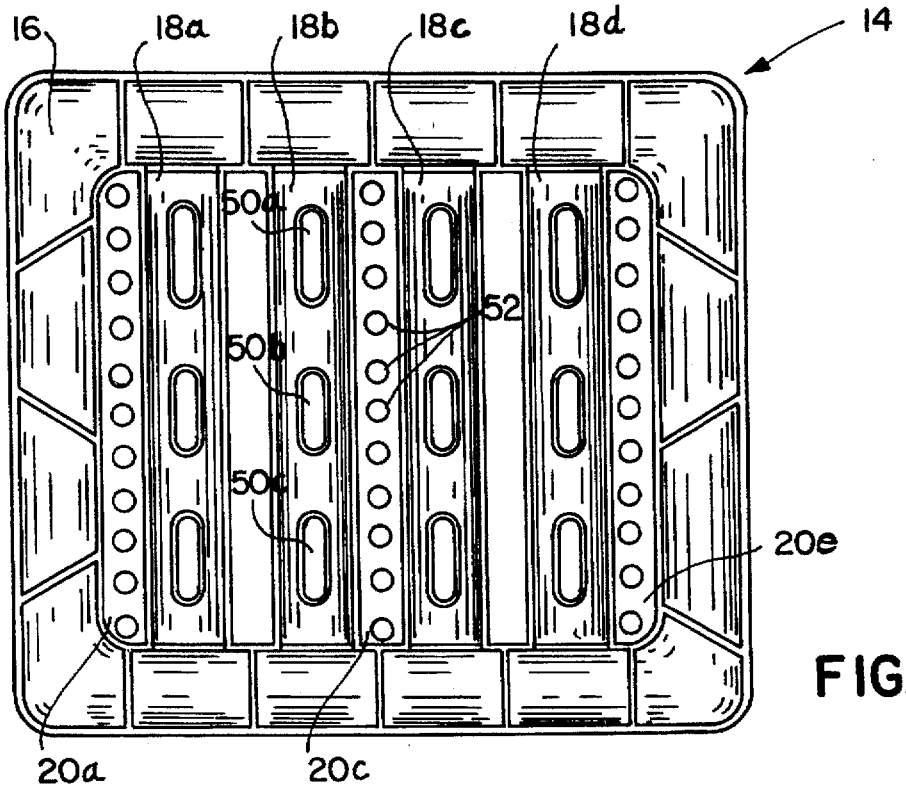
FIG. 4 is a front elevational view of the back radiator half.
Figure 5:
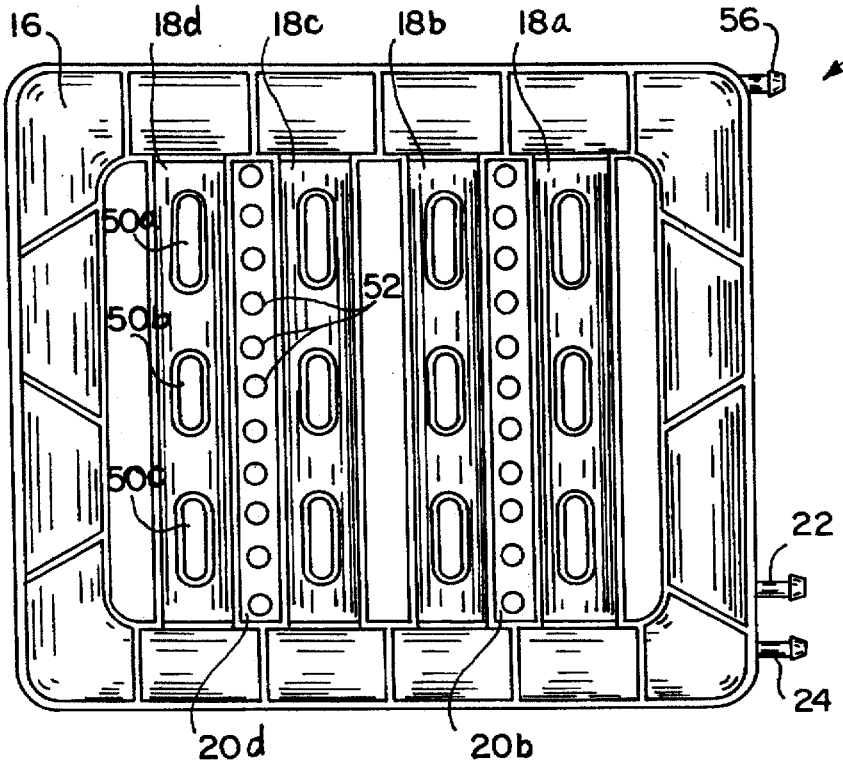
FIG. 5 is a back elevational view of the front radiator half.

The heat deflectors 20*a–e* are also integrally formed with the front and back radiator halves 12, 14. Each heat deflector 20*a–e* is formed as a single thickness, or layer, of plastic material webbed between adjacent secondary passages 18*a–d*. As perhaps best illustrated in FIGS. 3–5, adjacent heat deflectors are alternately formed as integral portions of the front or back radiator halves 12, 14. In particular, heat deflectors 20*a* and 20*c* are integrally formed with back radiator half 14, while heat deflectors 20*b* and 20*d* are integrally formed with front radiator half 12. A plurality of openings 52 are formed through the heat deflectors 20*a–e* to allow air to flow easily through the radiator. Increased air flow increases the rate of heat transfer from the radiator.

Inlet pipe 22 and outlet pipe 24 extend through a lower portion of the wall of front radiator half 12. The two pipes are dimensioned to receive conventional coolant hoses (not shown). In addition, an overflow pipe 56 extends through an upper portion of the wall of the front radiator half 12. The overflow pipe 56 is dimensioned to receive a conventional overflow hose (not shown).

II. Molding of Radiator Halves

The passageways 42 are formed in the internal baffle walls 30*a–b*, 32*a–e*, 34*a–c*, and 36*a–e* simultaneously with the manufacture of the radiator halves 12 and 14 in an injection molding machine. A method and apparatus for molding the radiator halves 12 and 14 is disclosed in U.S. Pat. No. 5,368,467 issued Nov. 29, 1994 to Hendrik Kleyn, which is incorporated herein by reference.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A polymeric radiator comprising:

a polymeric front radiator half;

a polymeric back radiator half mating with said front radiator half to define a plurality of coolant flow passages, said flow passages include a primary flow passage and a secondary flow passage, said secondary passage including an air flow channel and being in fluid communication with said primary flow passage;

said front and back radiator halves each integrally formed with internal baffle walls dividing said primary passage into cells, said internal baffle walls defining undercut openings allowing coolant to pass through said internal baffle walls;

an inlet pipe in fluid communication with said flow passages; and an outlet pipe in fluid communication with said flow passage.

2. The radiator of claim 1 wherein at least one of said internal baffle walls is oriented at a skewed angle with respect to the direction of flow of coolant.

3. A polymeric radiator comprising:

front and back polymeric radiator halves that define a space for the flow of coolant, said front and back radiator halves each including integral peripheral flanges, said space including communicating primary and secondary flow passages, said front and back radiator halves each integrally formed with a plurality of internal baffle walls dividing said primary passage into cells, said internal walls defining undercut openings allowing coolant to pass through said internal baffle walls, at least one of said plurality of internal baffle walls oriented at an angle with respect to the flow of coolant through said primary passage, said secondary passage being a tubular passage having longitudinally opposite open ends, wherein both of said open ends are in fluid communication with said primary passage, said primary passage extending substantially around the periphery of said radiator to surround said secondary passages;

means for sealing said flanges together;

inlet means for allowing coolant to enter said space; and outlet means for allowing coolant to exit said space.

4. A radiator comprising:

a polymeric front radiator half that cooperates with a polymeric back radiator half to define a primary flow passage surrounding a plurality of secondary flow passages, each of said radiator halves including an integral peripheral flange, said primary and secondary flow passages being in fluid communication with one another to allow coolant to flow throughout said radiator, said front and back radiator halves including a plurality of integral internal baffle walls dividing said primary flow passage into cells, said internal walls defining undercut openings allowing coolant to pass through said internal baffle walls, at least one of said plurality of internal baffle walls oriented at an angle with respect to the flow of coolant through said primary passage, said secondary flow passages being tubular passages and having longitudinally opposite open ends; both of said open ends of each of said secondary flow passages being in fluid communication with said primary flow passage, said primary passage extending substantially around the periphery of said radiator to surround said secondary passages;

means for sealing said flanges together;

inlet and outlet means for allowing coolant to enter and exit said radiator; and at least one of said front and back radiator halves having integrally formed flow deflectors extending between said radiator halves.

5. The radiator of claim 4 wherein said radiator halves define a plurality of air flow channels, each extending through one of said secondary flow passages.

* * * * *